US009993043B1

(12) United States Patent
Daley

(10) Patent No.: US 9,993,043 B1
(45) Date of Patent: Jun. 12, 2018

(54) ILLUMINATED SAFETY HELMET

(71) Applicant: Sean T. Daley, Hughes, MD (US)

(72) Inventor: Sean T. Daley, Hughes, MD (US)

(73) Assignee: Sean T. Daley, Hughesville, MD (US)

( * ) Notice: Subject to any disclaimer, the term of this patent is extended or adjusted under 35 U.S.C. 154(b) by 0 days. days.

(21) Appl. No.: 15/079,894

(22) Filed: Mar. 24, 2016

Related U.S. Application Data

(60) Provisional application No. 62/137,499, filed on Mar. 24, 2015.

(51) Int. Cl.

| | |
|---|---|
| ***F21V 21/08*** | (2006.01) |
| ***A42B 3/04*** | (2006.01) |
| ***F21V 33/00*** | (2006.01) |
| ***F21V 23/04*** | (2006.01) |
| ***F21L 4/02*** | (2006.01) |
| ***F21V 23/00*** | (2015.01) |
| *F21Y 101/02* | (2006.01) |

(52) U.S. Cl.
CPC ..... *A42B 3/0446* (2013.01); *F21L 4/02* (2013.01); *F21V 23/003* (2013.01); *F21V 23/0414* (2013.01); *F21V 33/0004* (2013.01); *F21Y 2101/02* (2013.01)

(58) Field of Classification Search
CPC ..... A42B 3/044
USPC ..... 362/103, 105, 106, 107
See application file for complete search history.

(56) References Cited

U.S. PATENT DOCUMENTS

| | | | | |
|---|---|---|---|---|
| 3,358,137 | A | 12/1967 | Sinclair et al. | |
| 4,002,895 | A * | 1/1977 | Ketler | A42B 3/044 362/106 |
| 4,199,802 | A | 4/1980 | Malm | |
| 4,793,007 | A | 12/1988 | Barnett | |
| 5,871,271 | A * | 2/1999 | Chien | A42B 3/044 362/103 |
| 7,221,263 | B2 | 5/2007 | Moore et al. | |
| 8,025,432 | B2 | 9/2011 | Wainright | |
| 8,070,307 | B2 | 12/2011 | Ho | |
| 8,529,082 | B1 | 9/2013 | Baker et al. | |
| 2008/0066218 | A1* | 3/2008 | Loizzo | A42B 3/044 362/105 |
| 2011/0101890 | A1 | 5/2011 | Robinson | |
| 2012/0057331 | A1* | 3/2012 | Janice | F21L 4/02 362/105 |

* cited by examiner

*Primary Examiner* — William Carter

(57) ABSTRACT

A safety helmet includes a shell, a plurality of internal lamps located on an inner surface of the shell, and a headlight assembly attached to an outer surface of the shell.

1 Claim, 5 Drawing Sheets

ILLUMINATED SAFETY HELMET

RELATED APPLICATIONS

The present invention is a continuation-in-part of, was first described in, and claims the benefit of U.S. Provisional Application No. 62/137,499, filed Mar. 24, 2015 the entire disclosures of which are incorporated herein by reference.

FIELD OF THE INVENTION

The present invention relates generally to safety headgear and, more particularly, to a safety helmet having an integral illumination system, and a removable headlight assembly.

BACKGROUND OF THE INVENTION

Hard hats, or safety helmets, are a common sight at construction sites and industrial establishments throughout the country. Their increased use, often required by regulatory agencies (e.g., OSHA), has resulted in reduced injuries, and the saving of many lives.

Another item commonly found at construction sites is that of a flashlight. Flashlights are commonly used to provide portable task lighting in dimly lit locations while performing a particular construction task.

One (1) disadvantage is that flashlights are typically required to be held in one's hand during use. If the other hand should be holding a tool, both hands of the worker are now occupied. Should someone else help hold the flashlight, now another person and their salary is involved in a simple task. Additionally, when someone else holds the flashlight, or when it is propped up, it is rarely aimed in right direction, and increases aggravation while jeopardizing the worker's safety.

Another disadvantage is found at crowded job sites, where worker identification may be difficult. Different colored hardhats are often used, but a person's task or job may change many times during the day without a change in hardhats. Also, certain colors of hardhats are hard to discern during low light conditions.

Accordingly, there exists a need that addresses the issues identified above.

SUMMARY OF THE INVENTION

The inventor has recognized the aforementioned inherent problems and lack in the art and observed that there is a need for a safety helmet that provides safety headgear for a worker and task illumination, as well as worker identification. The development of the present invention, which will be described in greater detail herein, departs from conventional solutions to fulfill this need.

In one (1) embodiment, the disclosed safety helmet includes a shell, a plurality of internal lamps located on an inner surface of the shell, and a headlight assembly attached to an outer surface of the shell.

In another embodiment, the disclosed safety helmet includes a shell. The shell includes a dome-shaped body including an inner surface and an outer surface. The body is one (1) of a transparent or a translucent material. The shell also includes a brim extending from a front of an outer surface, a pair of opposed "L"-shaped locking ears extending from the front of the outer surface, a protrusion extending from the front of the outer surface between the pair of locking ears, and a headliner connected to the inner surface and extending a circumference of the body. The safety helmet also includes a plurality of internal lamp sockets connected to the inner surface and extending a circumference of the body above the headliner and a plurality of internal lamps removably connected to the plurality of internal lamp sockets. The plurality of internal lamps is directed to illuminate through the body. The safety helmet also includes an internal lamp electrical compartment formed within the shell, an internal lamp power supply housed within the internal lamp electrical compartment, an internal lamp control switch located on underside surface of the brim and electrically interconnected between the internal lamp power supply and the plurality of internal lamps, and an internal lamp control circuit housed within the shell and electrically connected to the internal lamp control switch and the plurality of internal lamps. The internal lamp control circuit is configured to control illumination of selected ones of the plurality of internal lamps and a color of the illumination of the selected ones of the plurality of internal lamps in response to actuation of the internal lamp control switch. The safety helmet also includes a headlight assembly removably attached to the shell. The headlight assembly includes a housing comprising a shape approximately matching a profile shape of the front of the shell and a male bracket connected to a back surface of the housing. The male bracket is received within the pair of locking ears. The headlight assembly also includes a detent formed in the male bracket. The protrusion engages the detent when the male bracket is received within the pair of locking ears. The headlight assembly also includes a plurality of small exterior lamps connected to a front portion and side portions of the housing, a large exterior lamp connected to a center of a front portion of the housing, a headlight electrical compartment formed within the housing; a headlight power supply housed within the headlight electrical compartment, a headlight control switch located on the front portion of the housing and electrically interconnected between the headlight power supply and the plurality of small exterior lamps and the large exterior lamp, and a headlight control circuit housed within the headlight electrical compartment and electrically interconnected between the headlight control switch and the plurality of small exterior lamps and the large exterior lamp. The headlight control circuit is configured to control illumination of selected ones of the plurality of small exterior lamps and the large exterior lamp and a color of the illumination of the selected ones of the plurality of small exterior lamps and the large exterior lamp in response to actuation of the headlight control switch.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
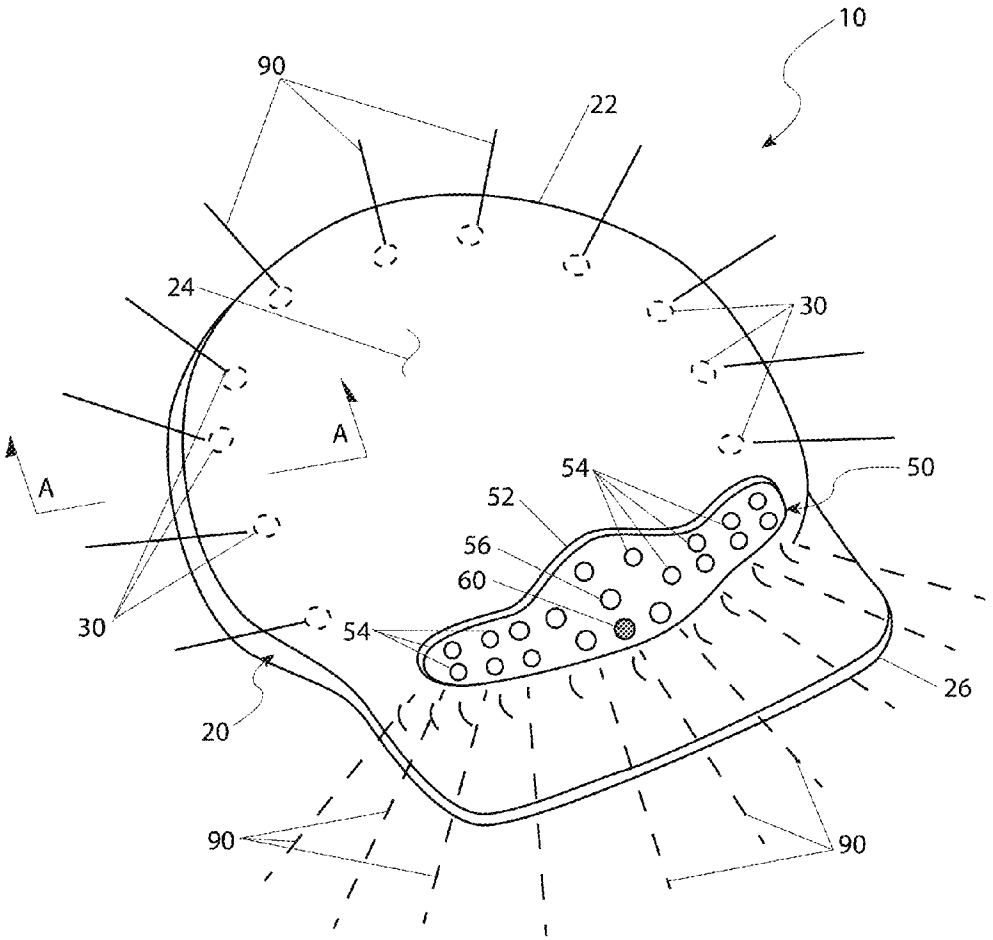
FIG. 1 is a top perspective view of an illuminated safety helmet, according to one embodiment of the present invention.

10 illuminated safety helmet
20 helmet assembly
22 shell
24 inner surface
26 brim
28 headliner
30 internal lamp
31 connector
32 socket
34 wiring
35*a* first controller circuit
35*b* second controller circuit
36*a* first electrical compartment
36*b* second electrical compartment
37 battery
38 first switch
39*a* first lid
39*b* second lid
42*a* first locking ear
42*b* second locking ear
43*a* protrusion
43*b* detent
46 male bracket
50 headlight assembly
52 housing
54 small lamp
56 large lamp
60 second switch
80 fastener
90 illumination

DETAILED DESCRIPTION OF THE PREFERRED EMBODIMENT

In accordance with the invention, the best mode is presented in terms of a one or more of the disclosed embodiments, herein depicted within FIGS. 1 through 5*b*. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-5*b*, disclosing an illuminated safety helmet (herein referred to as an "apparatus") 10, where like reference numerals represent similar or like parts. Generally, the disclosed apparatus 10 including a safety helmet assembly 20 having a translucent or transparent dome-shaped shell 22 that contains a plurality of multi-color internal lamps 30, which illuminate 90 the shell 22 from an inner surface 24, thereby providing a visible means of identification. The apparatus 10 also includes a removable headlamp assembly 50 attachable to a front surface of the shell 22 to provide general forward and wide-angle lighting to a user.

Figure 2:
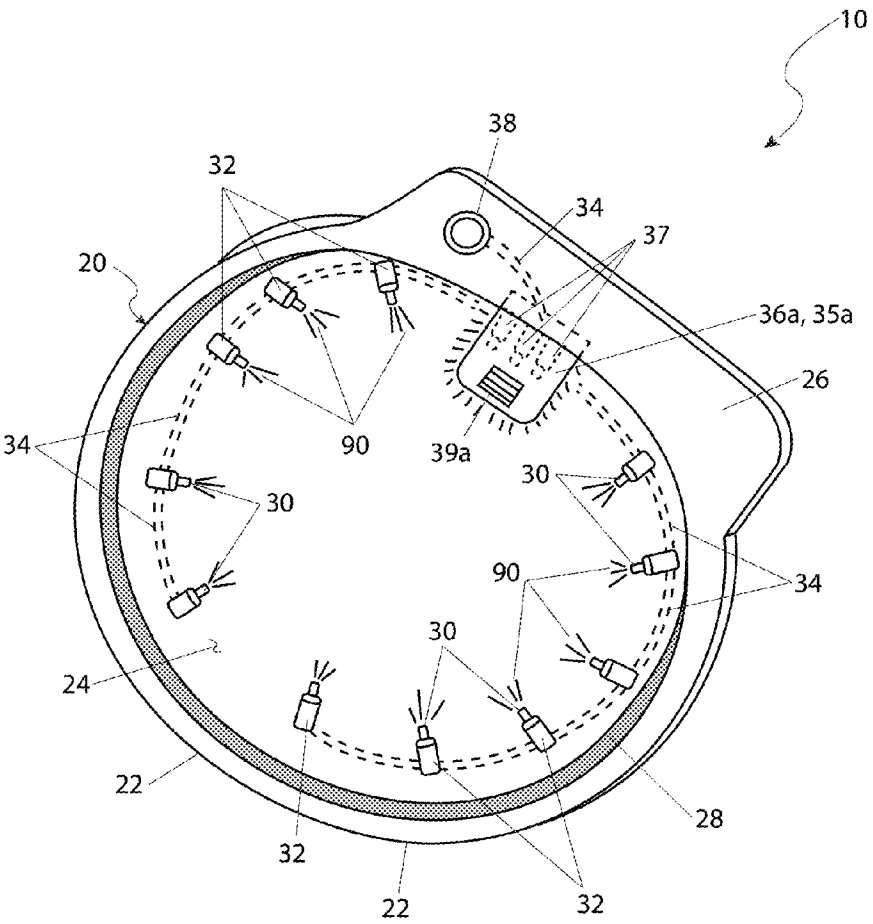
FIG. 2 is a bottom perspective view of the illuminated safety helmet, according to one embodiment of the present invention.

Referring to FIGS. 1 and 2, top and bottom perspective views of the apparatus 10, according to one (1) embodiment of the present invention, are disclosed. The internal lamps 30 are to be capable of changing color, preferably by utilizing clustered light emitting diodes (LED's) or an equivalent multi-color lamp technology. A selected color of the internal lamps 30, and consequently the shell 22, may be activated by sequentially pressing upon a first switch 38 (FIG. 2) located on (e.g., integrated into) a bottom surface of a forward brim 26 of the shell 22, allowing a user to sequence through the available colors as well as providing an ON-OFF function.

Figure 4:
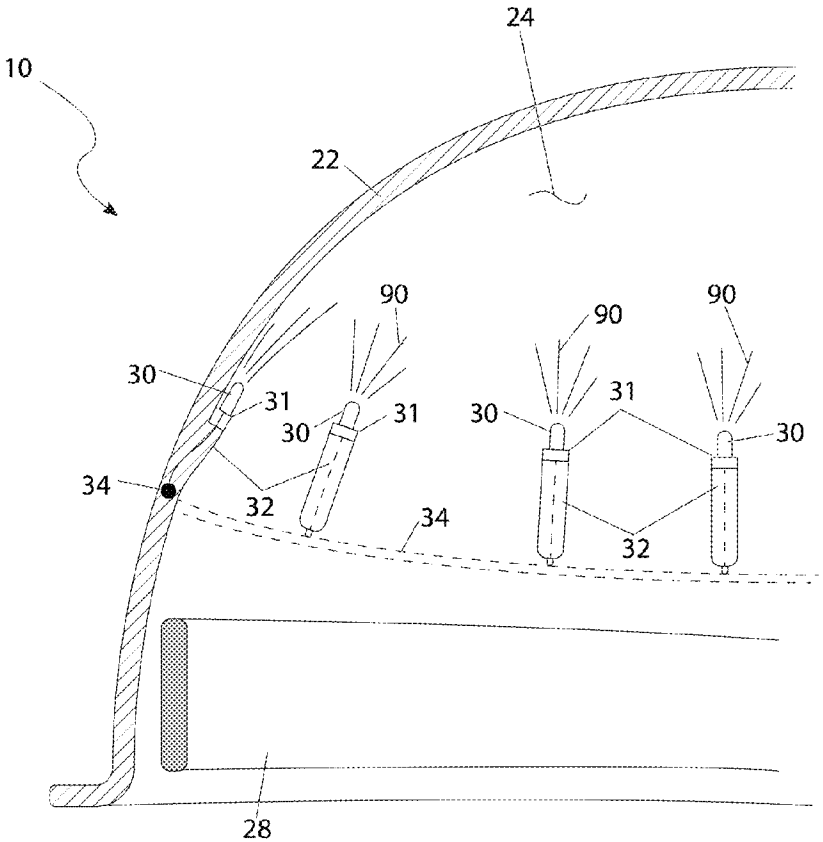
FIG. 4 is a partial section view of a helmet assembly of the illuminated safety helmet taken along section line A-A of FIG. 1, according to one embodiment of the present invention.

In one (1) example, the differently colored internal lamps 30 will illuminate 90 the dome 22 for the purpose of identifying a particular individual or their job duty. The internal lamps 30 are easily interchangeable for repair of replacement with a different color scheme via corresponding lamp sockets 32 (FIG. 2), which may be integrally-molded into the shell 22 along the inner surface, and respective connectors 31 (FIG. 4). In one (1) example, the sockets 32 are arranged in a circular pattern in an equally-spaced manner.

The shell 22 supplies power to the internal lamps 30 via a network of integrally-molded wiring 34 (FIG. 2), which connects each internal lamp 30 to a first electrical compartment 36*a* (FIG. 2), also molded into the inner surface 24 of the shell 22. The first electrical compartment 36*a* contains a first light controlling circuit 35*a*, a plurality of batteries 37 (e.g., rechargeable type), and a protective removable first lid 39*a*.

The apparatus 10 also includes an external forward-facing headlight assembly 50 (FIG. 1), which provides spot-light and wide-angle lighting effects to aid the user (e.g., wearer).

Figure 3:
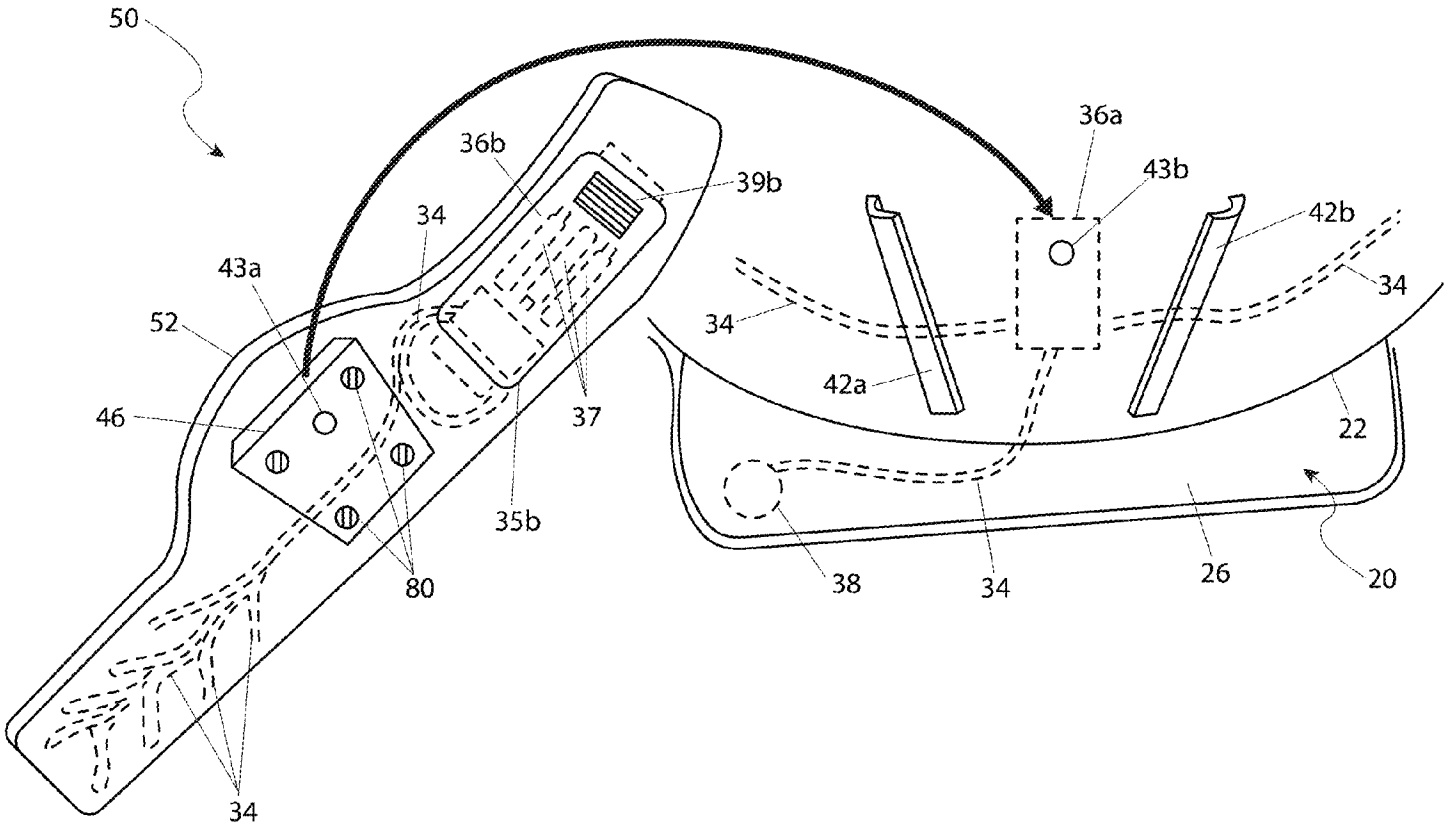
FIG. 3 is a partial view of the illuminated safety helmet showing a headlight assembly removed from the illuminated safety helmet, according to one embodiment of the present invention.

Referring to FIG. 3, an exploded view of the apparatus 10 depicting attachment/detachment of the headlight assembly 50, according to one (1) embodiment of the present invention, is disclosed. The headlight assembly 50 includes a horizontally elongated housing 52, for example, made using a plastic injection molding process. In one (1) example, the headlight assembly 50 has an arcuate shape to approximately conform to an outer surface of the shell 22. In one (1) example, the headlight assembly 50 is a stand-alone unit with onboard power, and having a plurality of replaceable small lamps 54 (FIG. 1) arranged along front and side surfaces, and one (1) replaceable large lamp 56 (FIG. 1) positioned approximately at a center location to provide a spot-light effect. Also positioned along a front surface is a second switch 60 (FIG. 1), for example, to provide a similar sequential function as the previously described first switch 38, capable of sequencing through modes such as, but not limited to: small lamps 54 only, large lamp 56 only, both lamps 54, 56, and an OFF mode.

The headlight assembly 50 further includes an integrally-molded second electrical compartment 36*b*, which provides similar functions and components as the first electrical compartment 36*a* of the shell 22, having a second controller circuit 35*b* and a plurality of batteries 37 being accessed via a removable second lid 39*b* located along a rear surface of the housing 52. The housing 52 includes integral wiring 34 to conduct power to the lamps 54, 56 and to the second switch 60.

The shell 22 of the helmet assembly 20 provides a means to removably attach the headlight assembly 50 a forward-facing surface of the shell 22. The example of the apparatus 10 illustrated here includes a first locking ear 42*a* and a second locking ear 42*b*, for example, being integrally-molded into the shell 22. The locking ears 42*a*, 42*b* provide mirror-image and diverging "L"-shaped appendages being sized and shaped to receive an interlocking trapezoidal-shaped male bracket 46 of the headlight assembly 50 in between.

The male bracket 46 provides a correspondingly shaped and sized appendage suitable for insertion and captivation within the locking ears 42*a*, 42*b*. The male bracket 46 is attached to the housing 52 of the headlight assembly 50, for example, using a plurality of fasteners 80, such as screws, rivets, or integrally molded thereto. The male bracket 46 and shell 22 include integrally-molded portions including respective recessed detent 43*a* and correspondingly positioned and sized protrusion 43*b*. Upon complete insertion of the male bracket 46 into the locking ears 42*a*, 42*b*, the protrusion 43*b* "snaps" into the detent 43*a*, thereby temporarily securing the headlight assembly 50 to the shell 22.

Referring now to FIG. 4, a sectional view of the helmet assembly 20 of the apparatus 10 taken along section line A-A of FIG. 1, according to one (1) embodiment of the present invention, is disclosed. The internal lamps 30 are secured within the shell 22 along a circular pattern slightly above a helmet liner 28 of the helmet assembly 20 via corresponding integrally-molded sockets 32 and connectors 31. The sockets 32 and connectors 31 are situated generally parallel to the inner surface 24 of the shell 22 so as to direct illumination 90 from the internal lamps 30 upwardly to illuminate 90 the translucent shell 22. Power from the batteries 37 (FIG. 2) located within the first electrical compartment 36*a* (FIG. 2) is conducted to each connector 31 via wiring 34 molded into the shell 22.

Figure 5B:
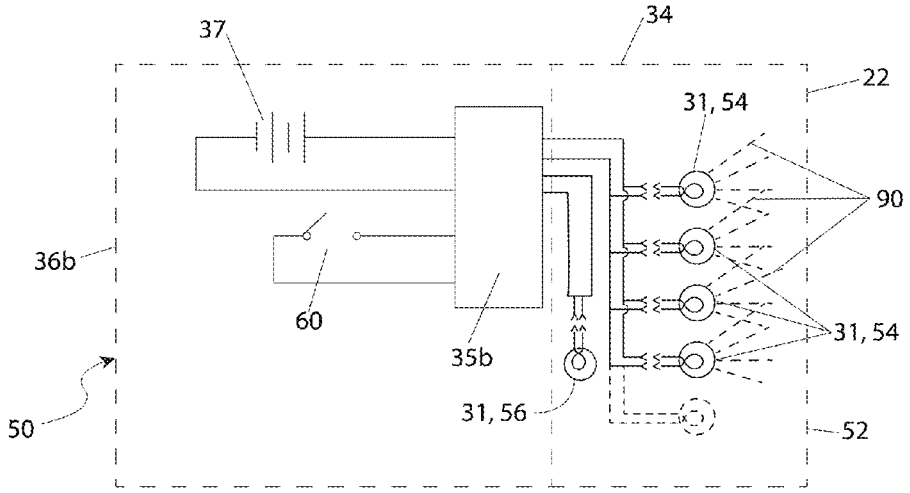
FIG. 5*a* is an electrical block diagram of the helmet assembly of the illuminated safety helmet, according to one embodiment of the present invention; and, FIG. 5*b* is an electrical block diagram of a headlight assembly of the illuminated safety helmet, according to one embodiment of the present invention.
Figure 5A:
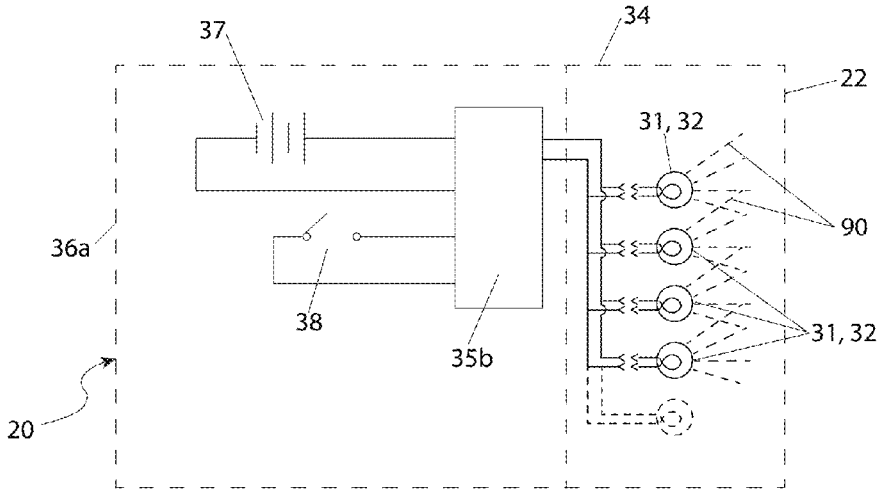

Referring to FIG. 5*a*, an electrical block diagram of the helmet assembly 20 of the apparatus 10, according to one embodiment of the present invention, is disclosed. Power to the internal lamps 30 is provided by batteries 37 and controlled by the first control circuit 35*a* and the first switch 38, the entirety of which may be contained within the first electrical compartment 36*a*. In one (1) example, the first control circuit 35*a* is a miniature circuit board device including signal input and output current capabilities in accordance with embedded software instructions, which allow a user to successively press the first switch 38 to select a desired color of the internal lamps 30 in the shell 22, as well as to turn the internal lamps 30 ON or OFF.

Referring now to FIG. 5*b*, an electrical block diagram of the headlight assembly 50 of the apparatus 10, according to one (1) embodiment of the present invention, is disclosed. The second electrical compartment 36*b* provides similar functions and components as the previously described first electrical compartment 36*a*, having the second controller circuit 35*b*, the plurality of batteries 37, and the second switch 60. The second electrical compartment 36*b* and second switch 60 provide power and control to the small lamps 54 and the large lamp 56 within the housing 52, and also act to turn the lamps 54, 56 OFF as the second switch 60 is pressed in a successive manner.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The example embodiments of the present invention can be utilized by the common user in a simple and effortless manner with little or no training. After initial purchase or acquisition of the apparatus 10, it would be utilized as indicated in FIGS. 1-3.

One (1) embodiment of the disclosed method for utilizing the apparatus 10 may include a series of steps, including: procuring the apparatus 10; removing the first lid 36*a* and second lid 36*b* from the shell 22 and housing 52; installing fresh batteries 37 into the first 36*a* and second 36*b* electrical compartments; replacing the lids 36*a*, 36*b*; installing the headlight assembly 50 upon the shell 22 by engaging and inserting the male bracket 46 in between the locking ears 42*a*, 42*b* of the shell 22 until the protrusion 43*a* and detent 43*b* portions are engaged; donning the helmet assembly 20 in a normal manner upon one's head; illuminating the translucent shell 22 by sequentially pressing the first switch 38, located upon a bottom surface of the brim 26 of the helmet assembly 20, until the shell 22 emits a desired color illumination 90 from the internal lamps 30; activating a desired illumination 90 from small lamps 34 and/or large lamp 36 of the head light assembly 50 to provide spotlight and/or wide-angle frontal illumination 90 by sequentially pressing the second switch 60 located upon the housing 52; deactivating the illumination 90 from the lamps 30, 54, 56 by pressing respective switches 38, 60 until the respective lamps 30, 54, 56 go out; and, benefiting from selective color identifying illumination 90 of a safety helmet 20 as well as providing general forward lighting, afforded a user of the present invention 10.

In the event one (1) or more lamps 30, 54, 56 burns out, the apparatus 10 provides sockets 32 and connectors 31 that allow a user to replace the lamps 30, 54, 56 as needed. Additionally, the headlight assembly 50 may be easily removed from the helmet assembly 20 using the male bracket 46, and be utilized as a stand-alone hand-held device as needed.

The different colors of the internal lamps 30 can be selected to identify a particular duty that the user is performing, or different trades could be distinguished by different color illumination 90. Additionally, differentiating colors can be utilized for foreman, supervisors, safety personnel, guests, and the like, to help distinguish their purpose, and reduce confusion on a crowded job site.

The foregoing descriptions of specific embodiments have been presented for purposes of illustration and description.

They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A safety helmet comprising:

a shell comprising:

a dome-shaped body comprising an inner surface and an outer surface, wherein said body is one of transparent or translucent;

a brim extending from a front of said outer surface;

a pair of opposed L-shaped locking ears extending from said front of said outer surface;

a protrusion extending from said front of said outer surface between said pair of locking ears; and, a headliner connected to said inner surface and extending a circumference of said body;

a plurality of internal lamp sockets connected to said inner surface and extending a circumference of said body above said headliner;

a plurality of internal lamps removably connected to said plurality of internal lamp sockets, wherein said plurality of internal lamps is directed to illuminate through said body;

an internal lamp electrical compartment formed within said shell;

an internal lamp power supply housed within said internal lamp electrical compartment;

an internal lamp control switch located on underside surface of said brim and electrically interconnected between said internal lamp power supply and said plurality of internal lamps;

an internal lamp control circuit housed within said shell and electrically connected to said internal lamp control switch and said plurality of internal lamps, wherein said internal lamp control circuit is configured to control illumination of selected ones of said plurality of internal lamps and a color of said illumination of said selected ones of said plurality of internal lamps in response to actuation of said internal lamp control switch; and, a headlight assembly removably attached to said shell, said headlight assembly comprising:

a housing comprising a shape approximately matching a profile shape of said front of said shell;

a male bracket connected to a back surface of said housing, wherein said male bracket is received within said pair of locking ears;

a detent formed in said male bracket, wherein said protrusion engages said detent when said male bracket is received within said pair of locking ears;

a plurality of small exterior lamps connected to a front portion and side portions of said housing;

a large exterior lamp connected to a center of a front portion of said housing;

a headlight electrical compartment formed within said housing;

a headlight power supply housed within said headlight electrical compartment;

a headlight control switch located on said front portion of said housing and electrically interconnected between said headlight power supply and said plurality of small exterior lamps and said large exterior lamp;

a headlight power supply housed within said headlight electrical compartment; and, a headlight control circuit housed within said headlight electrical compartment and electrically connected to said headlight control switch and said plurality of small exterior lamps and said large exterior lamp, wherein said headlight control circuit is configured to control illumination of selected ones of said plurality of small exterior lamps and said large exterior lamp and a color of said illumination of said selected ones of said plurality of small exterior lamps and said large exterior lamp in response to actuation of said headlight control switch.

* * * * *